US005599015A

United States Patent [19]

Shimizu et al.

[11] Patent Number: 5,599,015

[45] Date of Patent: Feb. 4, 1997

[54] SHEET FEEDER

[75] Inventors: Kaoru Shimizu, Osaka; Yutaka Matsuda, Toyonaka, both of Japan

[73] Assignee: Matsushita Electric Industrial Co., Ltd., Osaka, Japan

[21] Appl. No.: 495,918

[22] Filed: Jun. 28, 1995

[30] Foreign Application Priority Data

Jul. 6, 1994 [JP] Japan ..... 6-154660

[51] Int. Cl.[6] ..... B65G 13/12

[52] U.S. Cl. ..... 271/272; 271/109; 271/264; 271/273; 271/314; 198/782

[58] Field of Search ..... 271/272, 273, 271/264, 109, 314; 198/780, 782, 624; 193/37

[56] References Cited

U.S. PATENT DOCUMENTS 2,303,385 12/1942 Peters .
4,496,144 1/1985 Perun et al. .
5,407,054 4/1995 Matsuda et al. ..... 198/782 X
5,480,022 1/1996 Matsuda et al. ..... 198/782 X

FOREIGN PATENT DOCUMENTS 0621218 10/1994 European Pat. Off. .
9413429 12/1994 Germany .
3-20420 1/1991 Japan .
3-259843 11/1991 Japan .

*Primary Examiner*—David H. Bollinger
*Attorney, Agent, or Firm*—Ratner & Prestia

[57] ABSTRACT

A sheet feeder including at least a pair of variable outer diameter rollers and having a compact, simple and long life construction. The variable outer diameter roller includes a generally cylindrical pipe having four equally spaced penetrating holes radially disposed in its cylindrical wall, a sealing means having a diaphragm positioned adjacent each of the penetrating holes and fitted to the pipe support, and sliders forming a roller peripheral face fitted into each penetrating hole to be able to slide smoothly. Each slider is moved by diaphragms in a direction so the roller outer diameter expands by compressed air supplied through a fluid supply passage in a rotary axle which supports the roller. Exhausting the compressed air causes the roller outer diameter to decrease and restores the roller to its original size.

21 Claims, 9 Drawing Sheets

SHEET FEEDER

FIELD OF THE INVENTION

The present invention relates to a sheet feeder to catch and convey short or continuous long sheets, for example, ordinary paper by means of a pair of rollers whose outer diameters are variable.

DESCRIPTION OF THE PRIOR ART

In business machines, such as copying machines, short or continuous long sheets of ordinary paper are used.

In audio and video equipment, such as video tape recorders, continuous sheets made of polyester film coated with a magnetic material are used as a recording medium.

Industrial equipment, such as press machines or steel plate rolling machines, use short or continuous long sheets of steel.

A sheet feeder that catches and conveys sheets with a variable outer diameter roller, is proposed in Japanese Patent Laid-Open Application 3-259843.

The sheet feeder of the above application catches and conveys sheets with rollers whose outer diameters are variable.

The variable outer diameter roller is constructed so that the roller itself has a hollow interior. At least part of the roller is made of elastic. The elastic expands and contracts by supplying or exhausting fluid to or from the inside of the roller. This causes the outer diameter of the roller to vary.

A variable outer diameter roller using a fluid such as compressed air is proposed in Japanese Patent Laid-Open Application 3-20420. A tubular elastic is expanded by supplying a fluid (for example, air) to a pressure chamber (including a combination of a plurality of pressure chambers) made of tubular elastic and fixed to a rotary axle, thereby increasing the outer diameter of the roller.

In every one of the above-mentioned applications, an elastic body is expanded by a pressurized fluid (for example, compressed air) supplied to the inside of the tubular elastic body and the outer diameter of the tubular elastic body is varied.

The pressure of compressed air supplied in a factory with centralized control usually has a large variance from about 4.5 to 8 kgf/cm2 and is also unstable.

In the case in which there is a big difference in the outer diameter sizes between the expanded state and the contracted state (normal state), even if the elastic is made of soft material such as rubber, repeating over two million cycles of expansion with over 50% expansion rate is likely to cause fatigue failure due to tension. It is very difficult to get an inexpensive and durable material which can withstand repeated expansion and contraction.

Because the outer diameter of the roller varies corresponding to the pressure variation inside the elastic body, in order to make the expanded outer diameter size at expansion constant, it is necessary to precisely control the pressure of the supplied fluid. As a result, the construction becomes complex requiring an expensive, high performance pressure sensor and pressure control equipment.

The present invention solves the above problems and provides a sheet feeder having a simple and compact construction and a variable outer diameter roller with superior repeating strength.

SUMMARY OF THE INVENTION (First exemplary embodiment)

At least a pair of variable outer diameter rollers catches and conveys sheets. A sealing part in the form of diaphragms are disposed adjacent to each penetrating hole inside a pipe or main body of the roller. A plurality of penetrating holes are disposed in the cylindrical wall of the pipe which is fitted into the variable outer diameter roller. Sliders forming a peripheral face of the roller are fitted into each corresponding penetrating hole so that each slider is able to slide smoothly. The sealing part is held in airtight relation to the pipe by side plates disposed at both ends of the pipe. The sliders are pushed and moved, by fluid through the diaphragms, in a direction which expands the outer diameter of the roller.

(Second exemplary embodiment)

A pair of rollers, one of which is a variable outer diameter roller and the other is a fixed outer diameter roller, catches and conveys sheets. A sealing part in the form of diaphragms are disposed adjacent to each penetrating hole inside a pipe or main body of the roller. A plurality of penetrating holes are disposed in the cylindrical wall of the pipe which is fitted into the variable outer diameter roller. Sliders forming a peripheral face of the roller are fitted into each corresponding penetrating hole so that each slider is able to slide smoothly. The sealing part is held in air-tight relation to the pipe by side plates disposed at both ends of the pipe. The sliders are pushed and moved, by fluid through the diaphragms, in a direction which expands the outer diameter of the roller.

(Third exemplary embodiment)

A variable outer diameter roller and a flat plate catches and conveys sheets. A sealing part in the form of diaphragms are disposed adjacent to each penetrating hole inside a pipe or a main body of the roller. A plurality of penetrating holes are disposed in the cylindrical wall of the pipe which is fitted into the variable outer diameter roller. Sliders forming a peripheral face of the roller are fitted into each corresponding penetrating hole so that each slider is able to slide smoothly. The sealing part is held in air-tight relation to the pipe by side plates disposed at both ends of the pipe. The sliders are pushed and moved by fluid through the diaphragms in a direction which the sliders expand the outer diameter size of the roller.

In the variable outer diameter roller of the above-mentioned embodiments, a fluid (for example, compressed air) in the pipe is exhausted as needed and the sliders return to their original positions in the diaphragms of the sealing part by way of a coil spring or a rubber ring attached in the gutter of the peripheral part of the roller. As a result, the peripheral parts at the tops of the sliders return to their initial positions and the roller regains its initial small outer diameter.

In a sheet feeder in accordance with the present invention, the construction of the variable outer diameter roller is very simple and no excess force is applied to the diaphragms. Only a small amount of compression and bending distortion occurs when the diaphragms deform from a pot-shape to a flat plate-shape.

Therefore, no fatigue failure occurs over two million cycles of expansion and contraction using compressed air over 5 kgf/cm2.

Because the range of movement of the sliders are restricted by the side plates, the maximum outer diameter of the roller formed by the sliders is always constant, independent of the fluid pressure applied to the diaphragms.

There is no need to use an air cylinder or a magnetic solenoid to drive a mechanical element such as a lever supporting a variable outer diameter roller.

In the first exemplary embodiment, because each roller in the pair of rollers is a variable outer diameter roller, the sheet feeder can catch and convey sheets having a large variation in sheet thickness.

Figure 1A:
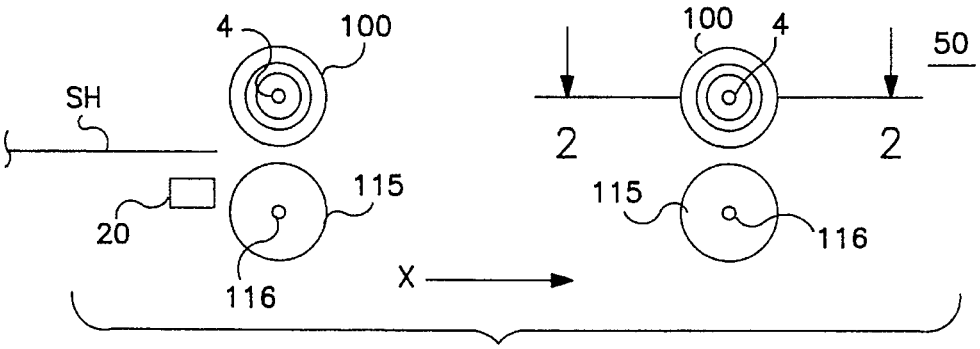
FIGS. 1(A) to 1(D) are schematic representations of a sheet feeder in accordance with a first exemplary embodiment of the present invention.

DETAILED DESCRIPTION OF THE INVENTION (First exemplary embodiment)

A sheet feeder in accordance with a first exemplary embodiment of the present invention is illustrated in FIGS. 1(A) to 1(D). A sheet feeder 50 to catch and convey short, single sheets or a long continuous sheet SH is composed of two pairs of rollers, a first pair of rollers (left side in FIG. 1) and a second pair of rollers (right side in FIG. 1).

The two pairs of rollers are positioned with a predetermined distance between them. Each pair of rollers includes a variable outer diameter roller 100 and a fixed outer diameter roller 115. In the normal state, there is a predetermined distance (gap) between the peripheral part of variable outer diameter roller 100 and the peripheral part of fixed outer diameter roller 115.

Each variable outer diameter roller 100 is rotated in a counter-clockwise direction by an independent driving source such as a driving motor and a power transmitting means such as a belt or gears. (Not shown in the figures)

In front of each pair of rollers, non-contact optical beam sensors 20 and 21 are located to detect an approaching sheet.

When optical beam sensors 20 and 21 detect an approaching sheet, each sensor independently controls each variable outer diameter roller 100 at a designated timing and at a rotation speed and enlarges the outer diameter of variable outer diameter roller 100 by supplying a fluid with designated pressure to each variable outer diameter roller 100. Each pair of rollers catches and conveys the sheet. Supplying and exhausting fluid are automatically executed using a fluid-controlled valve such as an electro-magnetic valve or a fluidic element (not shown). A roller axle 4 has a hollow central region for supplying a fluid to the variable outer diameter roller 100.

Axles 116 attached to fixed outer diameter rollers 115 are located in parallel to each other as well as in parallel with axles 4 of variable outer diameter rollers 100. They are supported with ball bearings or cylindrical metal bearings at both ends so that the axles 116 can rotate easily (not shown). In this case, axles 116 may be driven to rotate in a clock-wise direction by a driving source such as a motor or may freely rotate without any driving source.

FIG. 1(A) shows a state in which sheet SH is conveyed in a direction indicated by an arrow X and detected by optical beam sensor 20. The means to convey the sheet before approaching the position of sensor 20 is not shown.

Figure 1B:
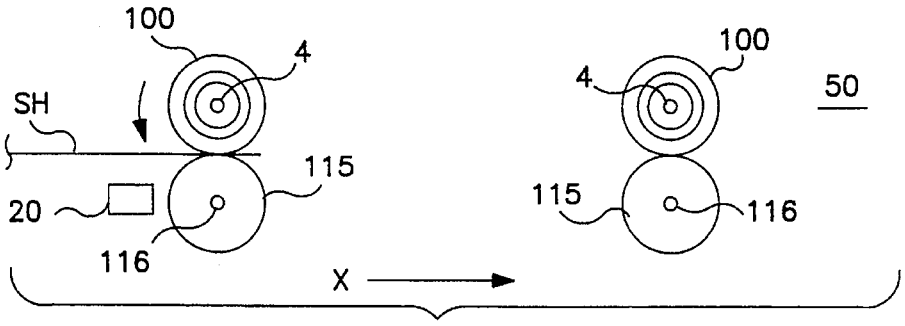

FIG. 1(B) shows a state in which sheet SH is further conveyed in the X direction and begins to be caught and conveyed by the first pair of rollers. As shown in the left side of FIG. 1(B), a fluid is supplied to the variable outer diameter roller 100 when sensor 20 detects the approaching sheet and the sheet is caught by the first variable outer diameter roller 100 having an enlarged diameter and a fixed outer diameter roller 115.

Figure 1C:
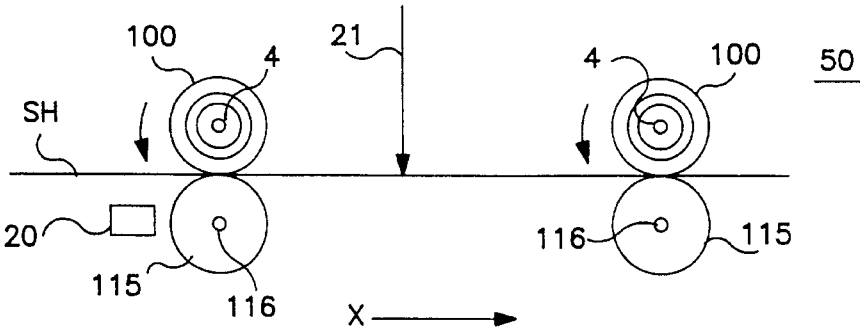

FIG. 1(C) shows a state in which sheet SH is further conveyed in the X direction by the first pair of rollers and begins to be caught and conveyed by the second pair of rollers. The second pair of rollers includes a variable outer diameter roller 100 with an enlarged diameter and a fixed outer diameter roller 115 as shown in the right side of FIG. 1(C). The driving of variable outer diameter roller 100 of the second pair is controlled by optical beam sensor 21.

Figure 1D:
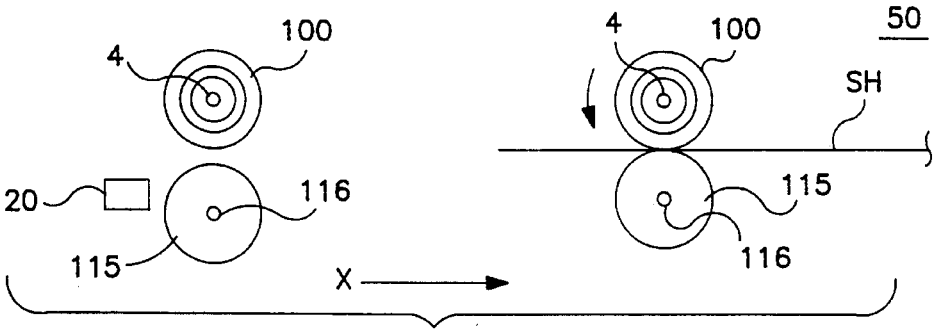

FIG. 1(D) shows a state in which sheet SH is further conveyed in the X direction, away from the first pair of rollers and caught and conveyed by the second pair of rollers. The outer diameter of variable outer diameter roller 100 of the first pair retracts to an initial state (small diameter) by exhausting a fluid. After the sheet passes the second pair of rollers, variable outer diameter roller 100 of the second pair of rollers retracts its outer diameter and returns to the state shown in FIG. 1(A).

The above actions are repeated for each supplied sheet.

In the above-mentioned pairs of rollers, the positions of variable outer diameter rollers 100 and fixed outer diameter rollers 115 may be reversed. Further, the sheet feeder may catch and convey sheets not only horizontally but also vertically.

Each one of fixed outer diameter rollers 115 of the first and second pairs of rollers may be replaceable with a variable outer diameter roller 100. That is, both rollers of a pair of rollers may be variable outer diameter rollers 100. The variable outer diameter rollers 100 are positioned to establish a predetermined distance between the peripheral parts of each roller. This configuration can catch and convey a wide range of sheets, from thin sheets to thick sheets.

(Second exemplary embodiment)

FIG. 14 is a schematic representation of a sheet feeder 51 in accordance with a second exemplary embodiment of the present invention.

In this case, sheet feeder 51 contacts a sheet SH-A which is positioned in L shaped housing 25. A variable outer diameter roller 100 is set at a fixed position with respect to housing 25. Sheets SH-A are caught between the peripheral part of enlarged variable outer diameter roller 100 and the flat bottom plate of housing 25. The sheets are fed one by one by rotating variable outer diameter roller 100.

Figure 14A:
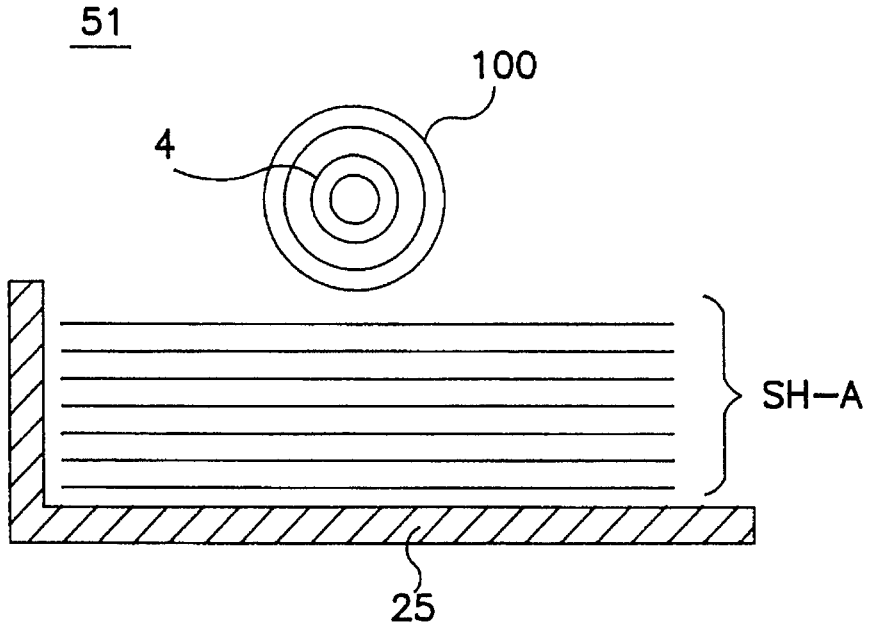
FIGS. 14(A) and 14(B) are schematic representations of a sheet feeder in accordance with a second exemplary embodiment of the present invention.

FIG. 14(A) shows a state before a sheet SH-A is fed. No fluid is supplied to variable outer diameter roller 100 and the outer diameter is an initial small size.

Figure 14B:
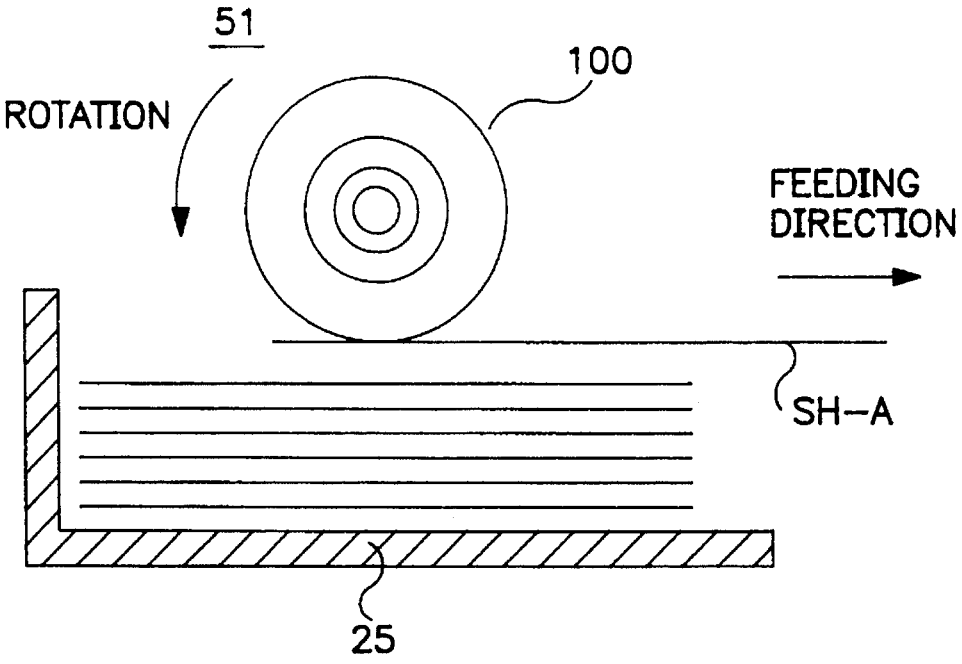

FIG. 14(B) shows a state as sheet SH-A is being fed. A fluid is supplied to variable outer diameter roller 100, the outer diameter is enlarged and the roller is rotated in a counter clockwise direction.

A variable outer diameter roller 100 used in a sheet transfer machine in accordance with the exemplary embodiments of the present invention is explained referring to FIGS. 2 to FIG. 9.

Figure 2:
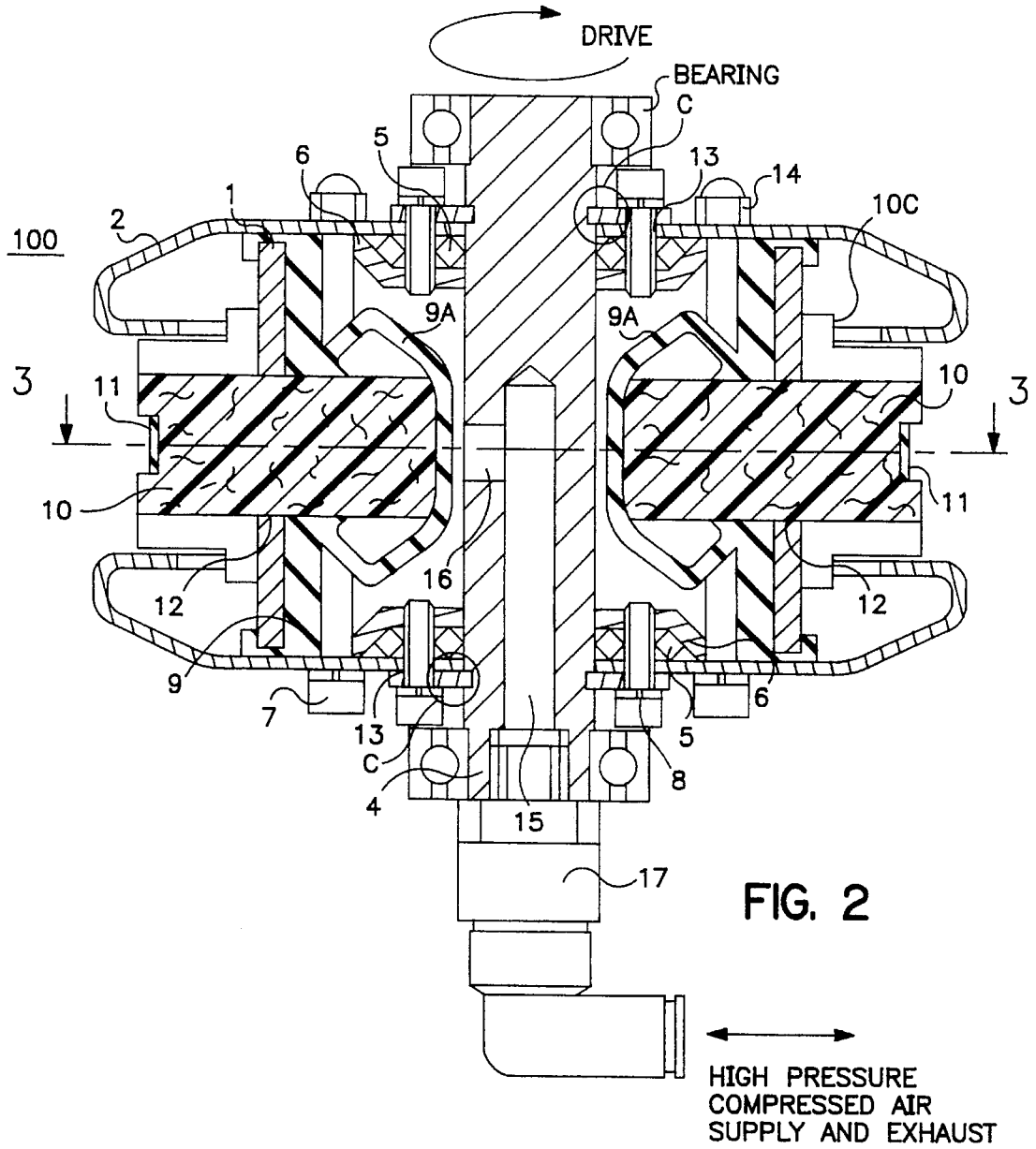
FIG. 2 is a cross sectional view of a variable outer diameter roller used in a sheet feeder in accordance with the first exemplary embodiment of the present invention taken along line 2—2 of FIG. 1A.
Figure 3:
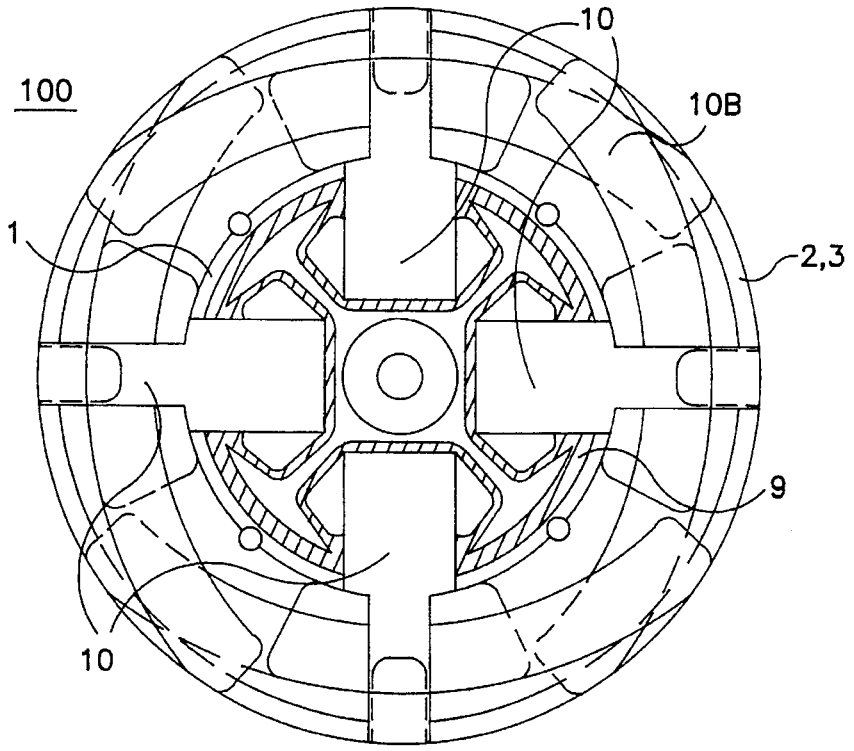
FIG. 3 is a cross sectional view of a variable outer diameter roller taken along line 3—3 of FIG. 2.

FIGS. 2 and 3 are cross sectional views of a variable outer diameter roller taken along line 2—2 of FIG. 1 and line 3—3 of FIG. 2, respectively.

Referring to FIGS. 2 and 3, a pipe 1 contains a plurality of penetrating holes, for example, four penetrating holes (apertures or receiving ports) 12 spaced 90 degrees apart in the cylindrical wall of the pipe 1. The pipe 1 is made of hard material such as metal, epoxy resin, fiber reinforced plastic or polystyrene and is formed from a metal pipe by a numerical controlled lathe or injection molding of resin.

The pipe 1 is disposed between side plates 2 and 3 through a rim portion 9C (shown in FIG. 6) of a sealing part 9. The side plates 2 and 3 can be press formed from a metal plate, but they may be made by injection molding of resin.

The roller axle 4 and the side plates 2 and 3 are held in air-tight relation to pipe 1 by disk-shaped rubber packings 5, disc-shaped packing holders 6 and bolts 7 and nuts 14.

Rectangular shaped anti-rotation plates 13 having generally semi-circular notches are put into the H-cut grooves at four locations (one each at upper and lower parts of the axle 4) as indicated by the letter C in FIG. 2 and are fixed to the side plates 2 and 3 together with the disc-shaped packing holders 6 by the bolts 8.

A part of the disc-shaped rubber packing 5 is forced in a direction to cause the peripheral part of the central aperture to contact the roller axle 4 and, according to the torque applied to the bolts 7, the rubber packings 5 form a seal between the axle 4 and the inside of the pipe 1. Accordingly, it is unnecessary to finish the surface of the roller axle 4 to a fine finish and sufficient sealing is effective even with a rough surface of the steel of the axle 4.

The side plates 2 and 3 and the pipe 1 are held in air tight relation by the rim portions 9C (upper and lower, in FIG. 6) of the sealing part 9, the bolts 7 and the nuts 14.

Figure 6:
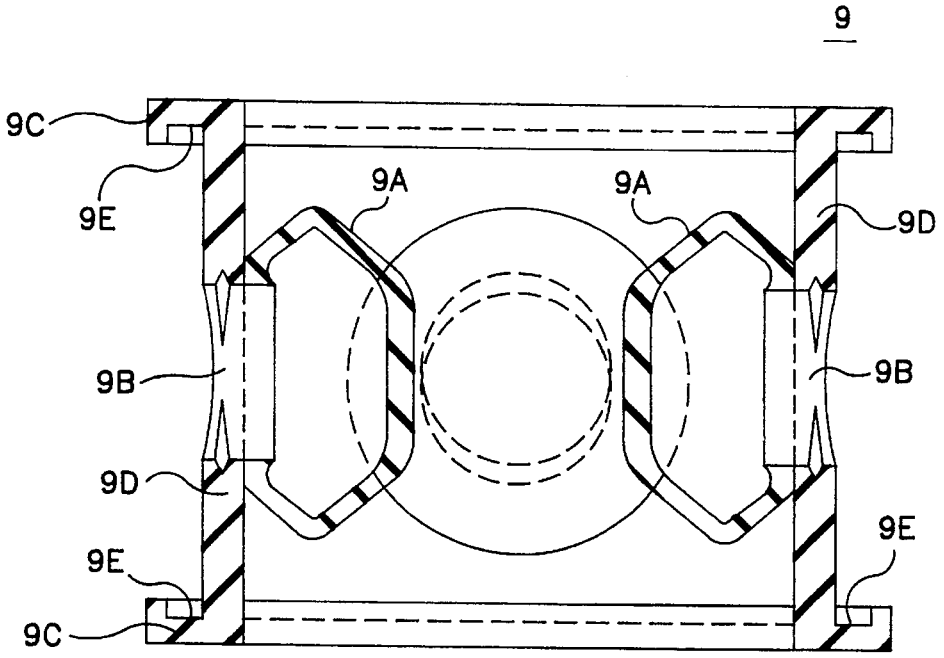
FIG. 6 is a vertical cross sectional view of a sealing part 9 included in the variable outer diameter roller shown in FIG. 2.
Figure 7:
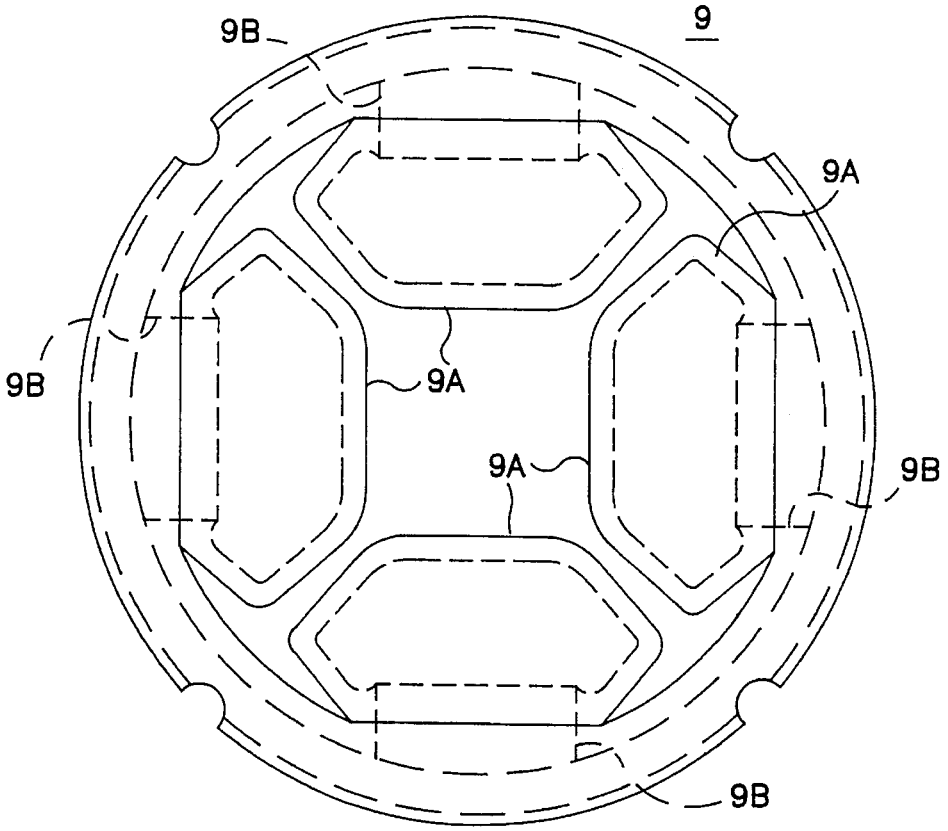
FIG. 7 is a horizontal cross sectional view of the sealing part 9 shown in FIG. 6.

The sealing part 9 is formed by molding elastic material such as silicone rubber, rubber material such as butyl rubber, or soft plastic in one unit as shown in FIGS. 6 and 7. Molding in one unit can be by, for example, casting or injection molding.

The sealing part 9 is tightly fitted into the pipe 1. As shown in FIGS. 6 and 7, the sealing part 9 is composed of a cylindrical trunk 9D, penetrating holes 9B, diaphragms 9A, rim portions 9C and circular grooves 9E.

The penetrating holes 9B are provided at four positions corresponding to each penetrating hole 12 provided on the cylindrical wall of the pipe 1 to support shafts 10A of sliders 10 which are fitted into the penetrating holes 9B and 12 so that the supporting shafts 10A can slide smoothly through the penetrating holes 9B and 12. The diaphragms 9A having a generally pot-shaped form are provided at four positions corresponding to each penetrating hole 12 provided on the cylindrical wall of the pipe 1 extend inside the cylindrical trunk 9D of sealing part 9.

The circular grooves 9E formed by the rim portions 9C of sealing part 9 overlap the ends of pipe 1 in order to make a tight seal possible between the side plates 2 and 3 and the pipe 1 by the bolts 7 and the nuts 14. The shape of the diaphragm 9A of sealing part 9 can be any shape such as a bellows or a polyhedron instead of a pot-shape.

The penetrating holes 12 in the cylindrical wall of the pipe 1 which the supporting shafts 10A of the sliders 10 are able to move smoothly are tightly sealed by the diaphragms 9A of the sealing parts 9 as shown in FIG. 2.

Figure 8:
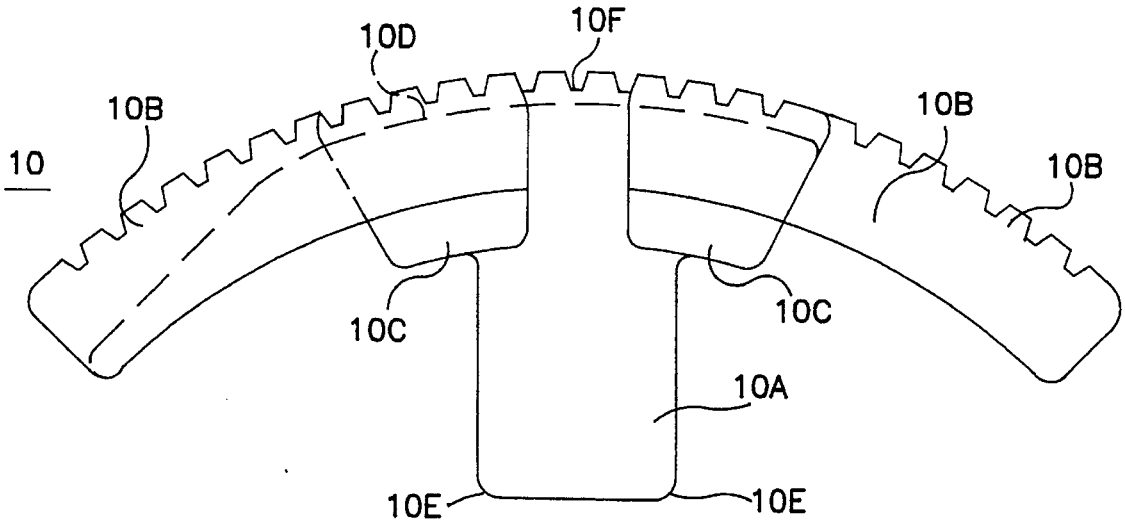
FIG. 8 is a side view of a slider 10 included in a variable outer diameter roller as shown in FIG. 2.
Figure 9:
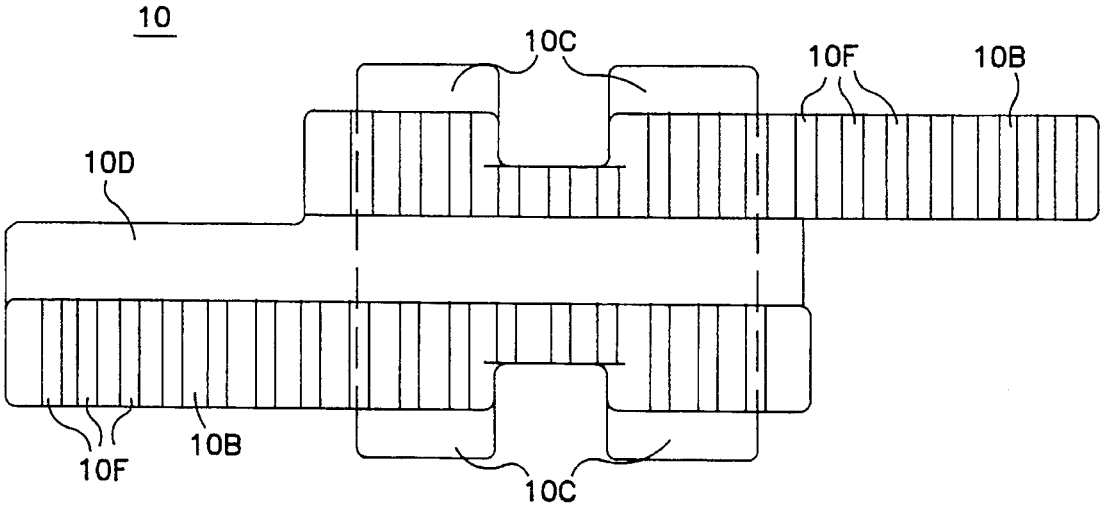
FIG. 9 is a top plan view of the slider 10 shown in FIG. 8.

A side view and a top plan view of the slider 10 are shown in FIGS. 8 and 9, respectively. The sliders 10 are constructed so that gutters 10D are between arc-shaped roller peripheral parts 10B. The arc-shaped roller peripheral parts 10B are at an end of the supporting shaft 10A and form a roller peripheral face.

The sliders 10 are molded in a desired shape from a resin such as fiber reinforced plastic. They may be made by, for example, machining metal, die casting or injection molding metals or resins.

The grooves 10F are provided at evenly spaced intervals to increase friction when contacting the sheet to be fed. Lining or attaching of rubber or plastic materials can take place in the gutters in order to increase friction or absorb shock when contacting with sheet.

The sliders 10 are constructed so that the gutters 10D are between the arc-shaped roller peripheral parts 10B which are symmetrically positioned at an end of the supporting shafts 10A. By symmetrically disposing the arc-shaped parts with a designated deviation, when the sliders 10 are radially disposed at four positions 90 degrees apart from each other, the structure can prevent mutual interference of the arc-shaped roller peripheral parts 10B and form roller peripheral parts 10B which are continuous when the outer diameter of the roller enlarges.

The disposing shape of the roller peripheral parts 10B is not restricted to being point symmetrical and they may be located like an alphabetical letter Y or S so that they become continuous.

Figure 5:
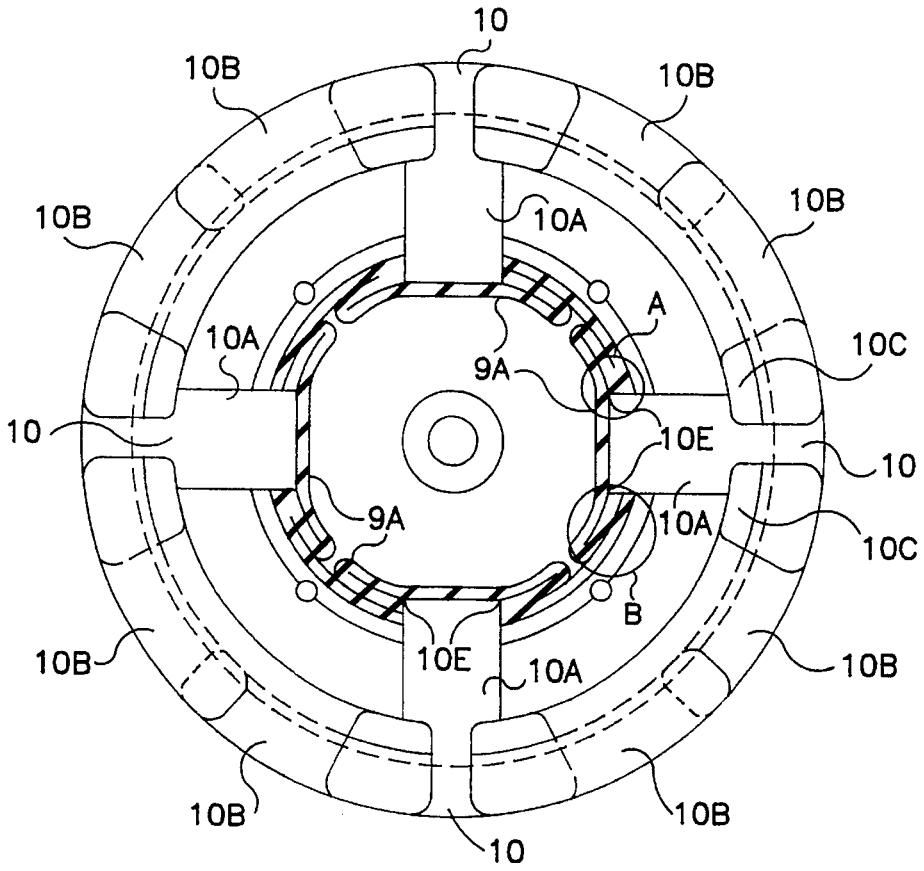
FIG. 5 is a cross sectional view of a variable outer diameter roller taken along line 5—5 of FIG. 4.

At one end of the slider 10 is a supporting shaft 10A (as shown in FIGS. 5 and 8). Rubber rings 11 (FIG. 2) are disposed in the gutters 10D of the sliders 10. The rubber ring 11 functions to push the sliders 10 (four pieces in the exemplary embodiment shown in FIG. 2) simultaneously towards the axis of the roller axle 4 and to restore the sliders 10 to the original positions (a small diameter state).

Instead of using the rubber ring 11 to restore the sliders 10 to their original positions, means to give negative pressure to the diaphragms 9A or means using ring-shaped tension coil springs connecting their starting point and ending point or any other means may be used.

A fluid such as compressed air is supplied to the cylindrical trunk 9D of the sealing part 9 by a designated timing signal through a rotary air coupling 17, a fluid passage 15 along the axis of the roller axle 4 and a transverse connecting hole 16.

Figure 4:
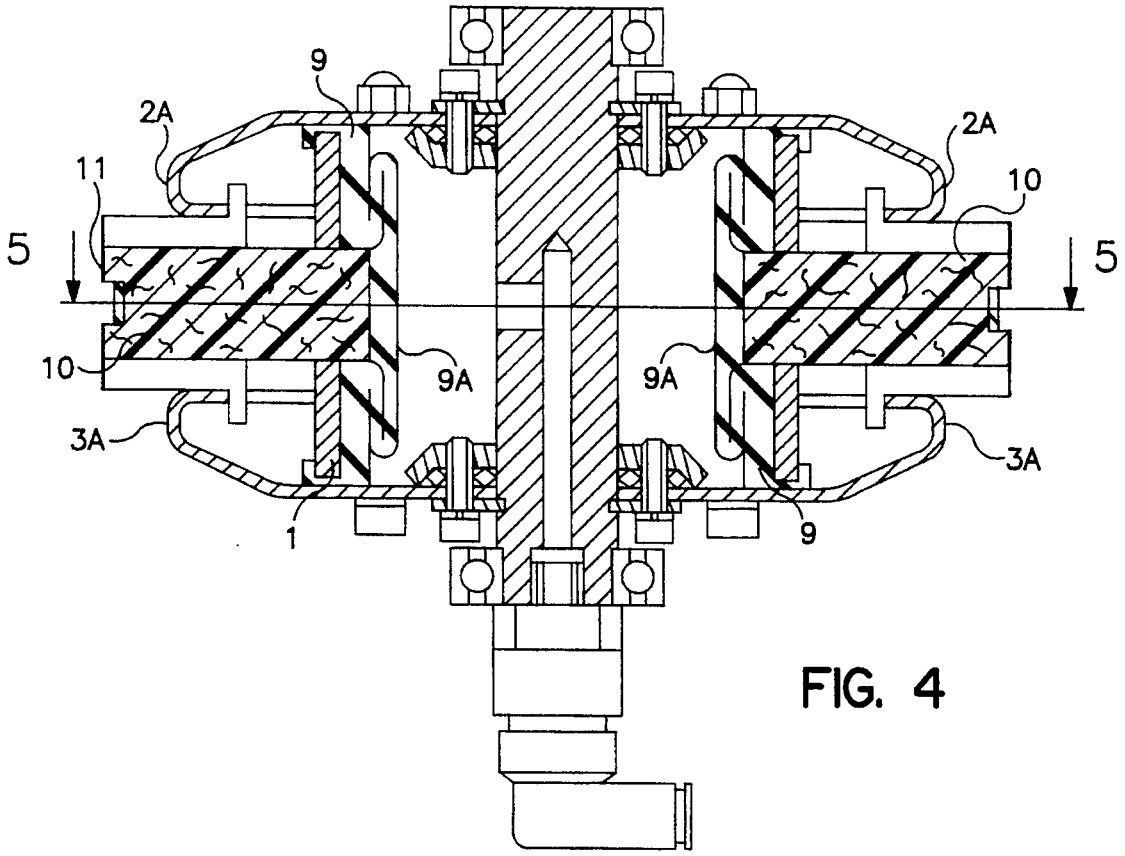
FIG. 4 is a cross sectional view of a variable outer diameter roller shown in FIG. 2, after compressed air is supplied to the roller.

The diaphragms 9A of the sealing part 9 are pushed by the compressed air, deform from a pot-shape to a flat plate-shape as shown in FIG. 4 and marked by B in FIG. 5 and push the supporting shafts 10A of the sliders 10 further out of the penetrating holes 12 of the pipe 1.

The end of the stroke (movement) of the sliders 10 pushed by the compressed air is a working limit (upper dead point)

of the sliders 10 where the protruding parts 10C of the sliders 10 strike against the hook-shaped rim portions 2A and 3A of the C-shaped side plates 2 and 3, respectively.

The roller peripheral parts 10B of the sliders 10 that are pushed outside the pipe 1 form a peripheral face having a desired larger outer diameter as shown in FIGS. 4 and 5. At the same time, they expand the rubber ring 11 fixed in the gutters 10D of the sliders 10.

The pressure resistance of cylindrical elastics made of rubber is usually as small as about 2 kgf/cm2. In the present invention, compressed air of 2 to 5 kgf/cm2 can be supplied to the diaphragms 9A.

At pressures used to enlarge the roller, the diaphragms 9A made of soft rubber deform to flat plates and are pushed into sharp edges or into small gaps. Repeated action on the diaphragm 9A causes the soft surface of the diaphragm 9A to peel off little by little and eventually its pressure resistance strength decreases and the diaphragm 9A will burst. In order to prevent the explosion or cracking of the diaphragms 9A from repeated working under high pressure, the edges of the supporting shafts 10A are made with round corners 10E as shown in FIG. 8.

Working with compressed air, the deformed portions of the diaphragms 9A are pushed to the inside wall of the cylindrical trunk 9D of the sealing part 9 and round corners 10E of the supporting shafts 10A, as shown in the circle A in FIG. 5, minimize the bending distortion of the sealing part 9.

The diaphragms 9A constructed in accordance with the present invention could realize a working life of over 2 million cycles under an air pressure of more than 5kgf/cm2.

When the compressed air pushing on diaphragms 9A is exhausted through the fluid passage 15 of the axle 4, the outer diameter of the variable outer diameter roller 100 retracts from an enlarged diameter to an original small diameter.

As the air pressure inside the sealing part 9 decreases, the supporting shafts 10A are pushed inside the pipe 1 by the tension of the rubber ring 11 to restore the sliders 10 to their original positions (small diameter) as shown in FIGS. 2 and 3. Then the peripheral face (outer diameter) of the roller peripheral part 10B becomes smaller than the outer diameter of the side plates 2 and 3.

In a small outer diameter state shown in FIG. 3, the roller peripheral parts 10B of the sliders 10 do not form a smooth circle. Unevenness occurs at the overlapped edge portions of the roller peripheral parts 10B. This is because of the desire to obtain a smooth circular peripheral face in an enlarged outer diameter state.

Instead of a smooth circle being formed at an enlarged diameter state, a smooth circle may be formed at a small diameter state. That is, the arc length and the curvature radius of the roller peripheral part 10B may be set arbitrarily.

Any other variation of the above-mentioned structure of a variable outer diameter roller using sliders spaced 90 degrees apart can be used.

As shown in FIGS. 10, 11, 12 and 13, for example, this embodiment may include a hollow axle 121 having connecting holes 122 and a plurality of penetrating holes 128 radially disposed and sliders 124 fitting into each one of penetrating holes 128 to be able to slide and forming a roller peripheral face. The sliders 124 are pushed and moved in a direction which increases the outer diameter of the roller by a fluid supplied through the connecting holes 122.

The variable outer diameter roller 400 has neither diaphragms 9A nor sealing part 9, such as found in a variable outer diameter roller 100 of FIG. 2.

The variable outer diameter roller 400 shown in FIGS. 10 to 13 are manufactured with the gap between the sliders 124 and the penetrating holes 128 to which the sliders 124 fit being very small, e.g. several ten micrometers wide and are finished to fit in accordance with H7f6 fitting grade. H7 refers to the tolerance on the hole or bearing side and f6 refers to the tolerance on the shaft. Grade H7f6 denotes about a 20 micrometer gap. Finishing to this degree results in the roller outer diameter being small and the variable outer diameter roller 400 being compact.

Figure 10:
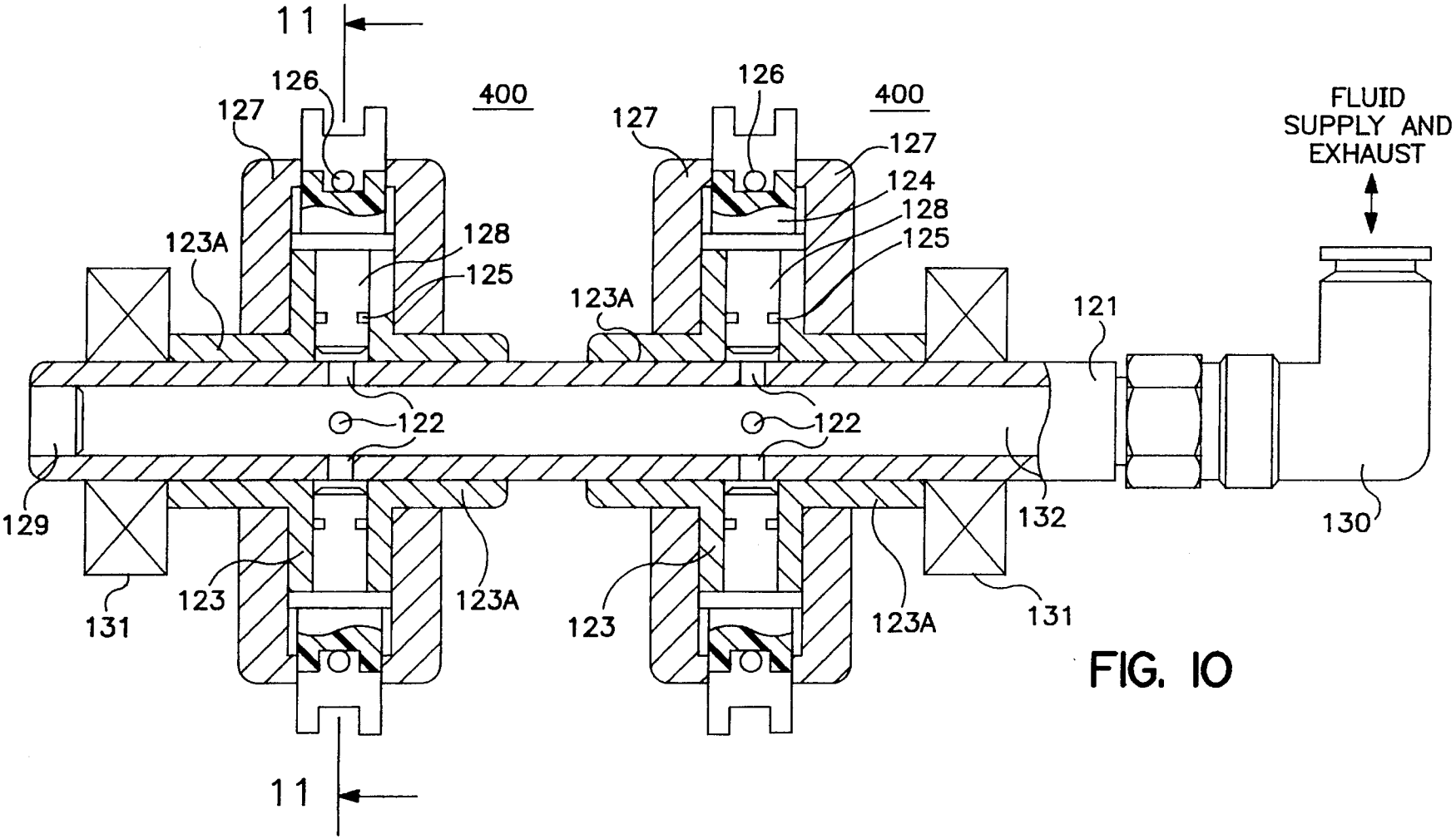
FIG. 10 is a cross sectional view of another variable outer diameter roller used in a sheet feeder shown in FIG. 1, taken in a plane including the axis of the axle.

FIG. 10 is a cross sectional view of two variable outer diameter rollers 400 attached at two positions on the hollow axle 121.

This construction has a better feeding function for broad sheets. In this case, it is important to make the outer diameter sizes of two variable outer diameter rollers 400 the same. In order to make the outer diameter sizes equal, for example, fluid is supplied after attaching the variable outer diameter rollers 400 at two positions of the hollow axle 121 and the roller outer diameter size is adjusted, for example, by grinding the outer diameter of the oversized roller.

Figure 11:
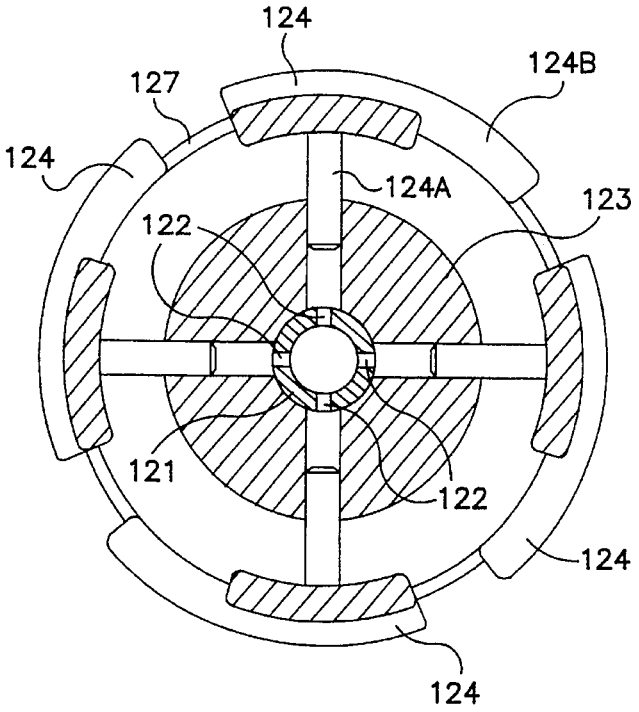
FIG. 11 is a cross sectional view of a variable outer diameter roller taken along line 11—11 of FIG. 10.

FIG. 11 is a cross sectional view taken along line 11—11 of a variable outer diameter roller 400 shown in FIG. 10 and shows the state when fluid is supplied to hollow axle 121 and the roller outer diameter enlarges, where rings 125 are not drawn.

Figure 12:
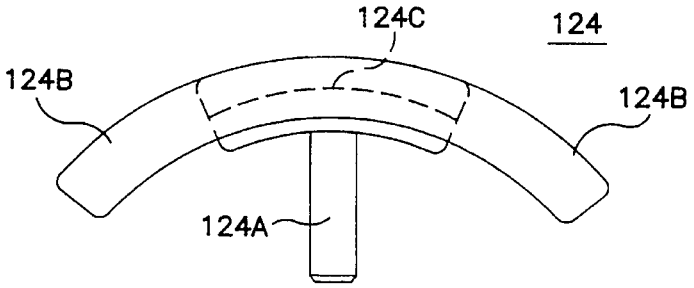
FIG. 12 is a side view of a slider 124 included in a variable outer diameter roller as shown in FIG. 10.
Figure 13:
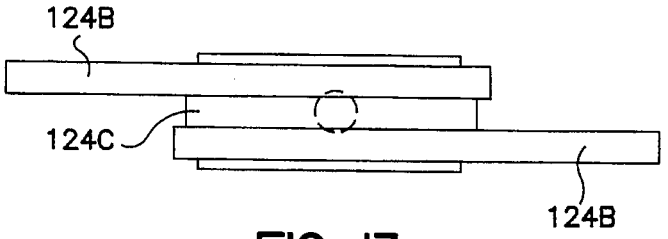
FIG. 13 is a top plan view of the slider 124 shown in FIG. 12.

FIGS. 12 and 13 are a side view and a top plan view of the slider 124, respectively.

Referring to FIG. 10, one end of the hollow axle 121 having a longitudinal fluid passage 132 to supply a fluid (for example air) along the axis of the hollow axle 121 is closed by a plug 129 and a rotary air coupling 130 is attached to the other end of the hollow axle 121. Air of a designated pressure is supplied to the fluid passage 132 of the axle 121 through a rotary air coupling 130.

The hollow axle 121 has a fixed length and is supported by bearings 131 provided at both ends of the hollow axle 121.

The hollow axle 121 has four connecting holes 122 in the wall of the fluid passage 132 of the hollow axle 121 radially positioned 90 degrees apart for each variable outer diameter roller 400. Thus, the hollow axle 121 has total of eight connecting passages (holes) 122.

The main disks 123 for supporting the sliders 124 are mounted on the hollow axle 121. Two main disks 123 are mounted on the hollow axle 121 in FIG. 10.

The main disk 123 includes four penetrating holes 128 positioned over the connecting holes 122 so that each penetrating hole 128 is connected to the fluid passage 132 through the connecting hole 122.

The sliders 124 are fitted into each penetrating hole 128 of the main disk 123 so that the sliders 124 can slide smoothly in the penetrating holes 128. In the exemplary embodiment shown in FIG. 10, four sliders 124 are fitted into a main disk 123. The slider 124 includes a supporting shaft 124A and a roller peripheral part 124B (as shown in FIG. 11), similar to the slider 10 of FIG. 2. The supporting shaft 124A has a designated clearance (gap) for fitting into the penetrating hole 128 and is finished to fit in accordance with H7f6 grade. One or two sealing rings 125 are attached around the supporting shaft 124A of the slider 124 at one or two positions (in FIG. 11, one position is shown) to prevent air leakage and dust infiltration.

The surface of the supporting shaft 124A is finished to a smooth surface, approaching a mirror surface, by turning on a lathe or grinding. When the slider 124 is made of resin or the like, however, a molding die with improved surface smoothness may be used and finishing work for the slider itself may be omitted.

The slider 124 provides two arc-shaped roller peripheral parts 124B extending equally from the shaft 124A and a gutter 124C is provided between the two roller peripheral parts 124B as shown in FIG. 13.

The shape of the roller peripheral part 124B of the slider 124 is similar to the shape of the roller peripheral part 10B of the slider 10 shown in FIG. 8 and the function and the construction of a tension coil spring 126 is similar to the rubber ring 11 of the assembly of FIG. 2. Enlarging of the outer diameter of the roller 400 is done in a manner similar to that of the variable outer diameter roller 100, thus the explanation is omitted.

In FIG. 10, the positions of the sliders 124 indicated by a broken line show the position of the outer diameters of the roller 400 when enlarged by air. Tension coil spring 126 is not shown in the extended position.

Two side plates 127 fixed on the outside of the main disk 123 restrict the motion of the sliders 124 and prevent rotation of the supporting shaft 124A of the slider 124.

The side plates 127 define a maximum diameter of the variable outer diameter roller 400 and prevent the sliders 124 from falling out of the penetrating holes 128 when the desired fluid pressure is introduced into the penetrating hole 128.

Other methods and devices for holding the sliders 124 may be used for the variable outer diameter roller 400 shown in FIG. 10. For example, a construction in which a main disk 123 and side plates 127 are made in one unit, a construction in which holding is done only by side plates 127 without a main disk 123 and a construction in which the main disk 123, side plates 127 and a hollow axle 121 are made in one unit.

Any material such as metal, resin or composite material may be used for the parts included in the variable outer diameter roller of the present invention. Any manufacturing means such as die casting, injection molding, press forming or cutting may be used to make the parts.

Thus, a sheet feeder including variable outer diameter rollers in which the sliders are radially moved and the outer diameter is enlarged is realized with a compact and simple construction. As a result, the cost is reduced.

The outer diameter size of the variable outer diameter roller is stable even if the fluid supply pressure varies largely. There is a large decrease in fatigue failure over two million cycles and the reliability is significantly increased.

The invention may be embodied in other specific form without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed:

1. A sheet feeder comprising:

at least a pair of variable outer diameter rollers for catching and conveying sheets; and wherein:

each of said variable outer diameter rollers comprises:

a pipe containing a plurality of penetrating holes disposed radially around the side wall of said pipe;

supporting means having an internal fluid supply passage connected to said penetrating holes; and a plurality of sliders forming a roller peripheral face, each disposed in one of said penetrating holes so that each slider is able to slide; and wherein:

said sliders are pushed and moved by a fluid supplied through said fluid supply passage in a direction so that the outer diameter of said roller enlarges.

2. A sheet feeder as recited in claim 1, wherein each of said sliders comprises:

an arc part forming a roller peripheral part with a designated angle; and a supporting shaft disposed in each of said penetrating holes.

3. A sheet feeder as recited in claim 2, wherein a resilient material is attached to said roller peripheral face.

4. A sheet feeder comprising:

at least a pair of variable outer diameter rollers for catching and conveying sheets;

each of said variable outer diameter rollers comprises:

a pipe containing a plurality of penetrating holes disposed radially around the side wall of said pipe;

supporting means having diaphragms disposed in each of said penetrating holes; and a plurality of sliders forming a roller peripheral face, each of said sliders disposed in one of said penetrating holes so that each slider is able to slide; and wherein:

said sliders are pushed and moved by a fluid supplied through said diaphragms in a direction so that the outer diameter of said roller enlarges.

5. A sheet feeder as recited in claim 4, wherein each of said sliders comprises:

an arc part forming a roller peripheral part with a designated angle; and a supporting shaft disposed in each of said penetrating holes.

6. A sheet feeder as recited in claim 5, wherein a resilient material is attached to said roller peripheral face.

7. A sheet feed comprising:

at least a pair of variable outer diameter rollers for catching and conveying sheets;

each of said variable outer diameter rollers comprises:

a pipe containing a plurality of penetrating holes set radially around the side wall of said pipe;

a sealing part having a diaphragm positioned adjacent each of said penetrating holes inside said pipe; and sliders forming a roller peripheral face and disposed in each penetrating hole so that each slider is able to slide; wherein said sealing part and said pipe are held in an air-tight relationship by side plates provided at both ends of said pipe; and said sliders are pushed and moved by a fluid supplied through said diaphragms is a direction so that the outer diameter of said roller enlarges.

8. A sheet feeder as recited in claim 7, wherein each of said sliders comprises:

an arc part forming a roller peripheral part with a designated angle; and a supporting shaft disposed in each of said penetrating holes.

9. A sheet feeder as recited in claim 8, wherein a resilient material is attached to said roller peripheral face.

10. A sheet feed comprising:

a pair of rollers, one of which is a variable outer diameter roller and the other is a fixed outer diameter roller, each of said variable outer diameter rollers comprising:

a pipe containing a plurality of penetrating holes disposed radially around the side wall of said pipe;

supporting means having an internal fluid supply passage connected to said penetrating holes; and a plurality of sliders forming a roller peripheral face, each of said sliders disposed in one of said penetrating holes so that each slider is able to slidc; and wherein said sliders are pushed and moved by a fluid supplied through said fluid supply passage in a direction so that the outer diameter of said roller enlarges.

11. A sheet feeder as recited in claim 10, wherein each of said sliders comprises:

an arc part forming a roller peripheral part with a designated angle; and a supporting shaft disposed in each of said penetrating holes.

12. A sheet feeder as recited in claim 11, wherein a resilient material is attached to said roller peripheral face.

13. A sheet feeder comprising:

a pair of rollers, one of which is a variable outer diameter roller and the other is a fixed outer diameter roller, said variable diameter roller comprises:

a pipe containing a plurality of penetrating holes disposed radially round the side wall of said pipe;

supporting means having diaphragms disposed in each of said penetrating holes; and a plurality of sliders forming a roller peripheral face, each of said sliders disposed in one of said penetrating holes so that each slider is able to slide, and wherein said sliders are pushed and moved by a fluid supplied through said diaphragms in a direction so that the outer diameter of said roller enlarges.

14. A sheet feeder as recited in claim 13, wherein each of said sliders comprises:

an arc part forming a roller peripheral part with a designated angle; and a supporting shaft disposed in each of said penetrating holes.

15. A sheet feeder as recited in claim 14, wherein a resilient material is attached to said roller peripheral face.

16. A sheet feeder comprising:

a pair of rollers, one of which is a variable outer diameter roller and the other is a fixed outer diameter roller, said variable outer diameter roller comprises:

a pipe containing a plurality of penetrating holes set radially around the side wall of said pipe;

a sealing part having a diaphragm positioned adjacent each of said penetrating holes inside said pipe; and sliders forming a roller peripheral face and disposed in each penetrating hole so that each slider is able to slide; wherein said sealing part and said pipe are held in air-tight relationship by side plates provided at both ends of said pipe; and said sliders are pushed and moved by a fluid supplied through said diaphragms in a direction so that the outer diameter of said roller enlarges.

17. A sheet feeder as recited in claim 16, wherein each of said sliders comprises:

an arc part forming a roller peripheral part with a designated angle; and a supporting shaft disposed in each of said penetrating holes.

18. A sheet feeder as recited in claim 17, wherein a resilient material is attached to said roller peripheral face.

19. A sheet feed comprising:

a variable outer diameter roller and a flat plate, and wherein said variable outer diameter roller comprises:

a pipe containing a plurality of penetrating holes disposed radially around the side wall of said pipe;

supporting means having an internal fluid supply passage connected to said penetrating holes; and a plurality of sliders forming a roller peripheral face, each of said sliders disposed in one of said penetrating holes so that each slider is able to slide; and wherein said sliders are pushed and moved by a fluid supplied through said fluid supply passage in a direction so that the outer diameter of said roller enlarges.

20. A sheet feeder comprising:

a variable outer diameter roller and a flat plate, and wherein said variable outer diameter roller comprises:

a pipe containing a plurality of penetrating holes disposed radially around the side wall of said pipe;

supporting means having diaphragms connected to said penetrating holes; and a plurality of sliders forming a roller peripheral face, each of said sliders disposed in one of said penetrating holes so that each slider is able to slide; and wherein said sliders are pushed and moved by a supplied fluid through said diaphragms in a direction so that the outer diameter of said roller enlarges.

21. A sheet feeder comprising:

a variable outer diameter roller and a flat plate, said variable outer diameter roller comprises:

a pipe containing a plurality of penetrating holes set radially around the side wall of said pipe;

a sealing part having a diaphragm positioned adjacent each of said penetrating holes inside said pipe; and sliders forming a roller peripheral face and disposed in each penetrating hole so that each slider is able to slide; wherein said sealing part and said pipe are held in air-tight relationship by side plates provided at both ends of said pipe; and said sliders are pushed and moved by fluid supplied through said diaphragms in a direction so that the outer diameter of said roller enlarges.

* * * * *

UNITED STATES PATENT AND TRADE MARK OFFICE

CERTIFICATE OF CORRECTION

PATENT NO. : 5,599,015
DATED : February 4, 1997
INVENTOR(S) : Shimizu et al.

It is certified that error appears in the above-identified patent and that said Letters Patent is hereby corrected as shown below:

In column 10, claim 7, line 53, delete "is" and insert --in--.

Signed and Sealed this

Twenty-fourth Day of June, 1997

Bruce Lehman

*Attest:*

BRUCE LEHMAN

*Attesting Officer*

*Commissioner of Patents and Trademarks*